US011241095B1

(12) United States Patent
Sun

(10) Patent No.: US 11,241,095 B1
(45) Date of Patent: Feb. 8, 2022

(54) DUAL-USE BLEACHER SEAT

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/095,761

(22) Filed: Nov. 12, 2020

(51) Int. Cl.

| | |
|---|---|
| ***A47C 1/16*** | (2006.01) |
| ***A47C 4/34*** | (2006.01) |
| ***A47C 4/44*** | (2006.01) |
| ***A47C 4/30*** | (2006.01) |
| ***A47C 13/00*** | (2006.01) |

(52) U.S. Cl.
CPC ..... *A47C 1/16* (2013.01); *A47C 4/30* (2013.01); *A47C 4/34* (2013.01); *A47C 4/44* (2013.01); *A47C 13/00* (2013.01)

(58) Field of Classification Search
CPC .... A47C 1/16; A47C 4/10; A47C 4/20; A47C 4/30; A47C 4/34; A47C 4/44; A47C 13/00; A47C 5/10; A47C 7/407
USPC ..... 297/16.1, 47, 53, 118, 252, 352
See application file for complete search history.

(56) References Cited

U.S. PATENT DOCUMENTS

| | | | | | |
|---|---|---|---|---|---|
| 116,934 | A * | 7/1871 | Cutter | A47C 1/16 | 297/252 |
| 897,737 | A * | 9/1908 | Goodrich | A47C 4/52 | 297/54 |
| 1,914,006 | A * | 6/1933 | Walter | A47C 4/20 | 403/61 |
| 2,306,673 | A * | 12/1942 | Tucker | A47C 1/16 | 297/252 |
| 2,694,441 | A * | 11/1954 | Degenfelder | A47C 1/16 | 297/17 |
| 2,957,515 | A * | 10/1960 | Gibson | A47C 4/18 | 297/252 |
| 3,994,529 | A * | 11/1976 | Lippert | A47C 1/16 | 297/252 |
| 10,694,851 | B2 * | 6/2020 | Zhu | A47C 1/16 | |
| 2009/0243345 | A1 * | 10/2009 | Carter | A47C 7/407 | 297/16.2 |

(Continued)

FOREIGN PATENT DOCUMENTS

| | | | | |
|---|---|---|---|---|
| CN | 208540960 U * | 2/2019 | | |
| DE | 202013104328 U1 * | 1/2014 | | A47C 11/00 |
| DE | 202013104794 U1 * | 1/2014 | | A47C 1/16 |

*Primary Examiner* — Robert Canfield
(74) *Attorney, Agent, or Firm* — WPAT Law, P.C.; Anthony King

(57) ABSTRACT

A dual-use bleacher seat having a backrest, a cushion assembly and two L-shaped hooks, wherein the backrest is connected to the cushion assembly, and the two L-shaped hooks are arranged on left and right sides of the front end of the bottom surface of the cushion assembly respectively. The dual-use bleacher seat further having two U-shaped leg tubes which are rotatably connected to left and right sides of the bottom surface of the cushion assembly respectively. The dual-use bleacher seat of the utility model can serve as a bleacher seat and can also be used for daily recreations and rests, so that the use frequency of the bleacher seat is increased, and the application range of the bleacher seat is expanded; and the dual-use bleacher seat is easy to fold and store and convenient to carry and satisfies the use requirements of users in different environments.

19 Claims, 11 Drawing Sheets

(56) References Cited

U.S. PATENT DOCUMENTS

| | | | | |
|---|---|---|---|---|
| 2014/0346817 | A1* | 11/2014 | Tseng | A47C 4/44<br>297/16.1 |
| 2019/0231074 | A1* | 8/2019 | Grace | A47C 4/28 |
| 2020/0054139 | A1* | 2/2020 | Morley, Jr. | A47C 4/22 |

* cited by examiner

DUAL-USE BLEACHER SEAT

BACKGROUND OF THE INVENTION

1. Technical Field

The utility model belongs to the technical field of seats, and particularly relates to a dual-use bleacher seat.

2. Description of Related Art

Nowadays, the vigorous development of social productivity has greatly improved the material comfort and spiritual pursuit of people and brought more and more large-scale sports matches, concerts and evening parties, which in turn promote the emergence of derivatives such as movable bleachers and bleacher seats.

Traditional bleacher seats have only one function and are typically fixedly mounted on bleachers to meet application requirements for watching matches and attending concerts in large places. In daily life, the bleacher seats have to be stored at a corner of a warehouse when not used, thus occupying too much space and being difficult to manage. Therefore, the traditional bleacher seats cannot be fully used by users for rests in daily life due to limitations of their service environments.

BRIEF SUMMARY OF THE INVENTION

The objective of the utility model is to overcome the defect that traditional bleacher seats are only applicable to bleacher environments by providing a dual-use bleacher seat, which not only can serve as a bleacher seat, but also can be used for daily recreations and rests, so that the use frequency of the bleacher seat is increased, and the application range of the bleacher seat is expanded; and the bleacher seat is easy to fold and store and convenient to carry and satisfies the use requirements of users in different environments.

To fulfill the aforesaid objective, the utility model adopts the following technical solution: a dual-use bleacher seat comprises a backrest, a cushion assembly and two L-shaped hooks, wherein the backrest is connected to the cushion assembly, and the two L-shaped hooks are arranged on the left and right sides of the front end of the bottom surface of the cushion assembly respectively; and the dual-use bleacher seat further comprises two U-shaped leg tubes which are rotatably connected to left and right sides of the bottom surface of the cushion assembly respectively.

Furthermore, a concave cavity is formed in the bottom surface of the cushion assembly, and when rotated to be folded on the cushion assembly, the U-shaped leg tubes are received in the concave cavity.

Furthermore, the L-shaped hooks are rotatably connected to the bottom surface of the cushion assembly, and the L-shaped hooks and the U-shaped leg tubes are folded in a staggered manner to be received in the concave cavity.

Furthermore, the cushion assembly comprises a seat cloth and a rectangular cushion frame, wherein the left and right sides of the seat cloth are fixedly mounted on the left and right sides of the cushion frame, and the concave cavity is formed between the lower surface of the seat cloth and the cushion frame.

Furthermore, the dual-use bleacher seat further comprises four U-shaped elastic connectors, wherein U-shaped metal sheets are wrapped and mounted in inner cavities of the U-shaped elastic connectors, the four U-shaped elastic connectors are symmetrically mounted at four corners of the bottom surface of the cushion assembly, the upper ends of the two L-shaped hooks are rotatably connected to the outer walls of the two U-shaped elastic connectors on the front side of the cushion assembly, and the two ends of each U-shaped leg tube are arranged in the inner cavities of the two U-shaped elastic connectors on the left or right side of the cushion assembly respectively and are rotatably connected to the U-shaped elastic connectors.

Furthermore, the dual-use bleacher seat further comprises elastic pieces with round pins, wherein the elastic pieces with the round pins are mounted in open ends of outer tubes of the U-shaped leg tubes, and the round pin of each elastic piece is clamped in a through hole in one side of the corresponding U-shaped elastic connector and is opposite to a press protruding point in the inner cavity of the U-shaped elastic connector; and press marks are arranged on the outer walls, corresponding to the press protruding points, of the U-shaped elastic connectors.

Furthermore, oblique concave faces and clamping protrusions are further arranged in the inner cavities of the U-shaped elastic connectors; and when the U-shaped leg tubes are in an unfolded state, the outer walls of the tube ends of the U-shaped leg tubes abut against the oblique concave faces and the clamping protrusions.

Furthermore, the backrest is rotatably connected to the cushion assembly.

Furthermore, the dual-use bleacher seat further comprises a metal connecting piece, wherein the upper end of the metal connecting piece is riveted to the lower left end or the lower right end of the backrest, and the lower end of the metal connecting piece is riveted to the left rear end or the right rear end of the cushion assembly.

Furthermore, the dual-use bleacher seat further comprises L-shaped elastic leg pads which are mounted on the sides, towards the ground, of two bent parts of a cross tube of each U-shaped leg tube.

Compared with the prior art, the utility model has the following beneficial effects: the dual-use bleacher seat can serve as a bleacher seat and be used for recreations and rests, has the advantages of being simple in structure, attractive, elegant, firm and durable, can be folded to be stored, and can be carried and used in different environments.

Figure 1A:
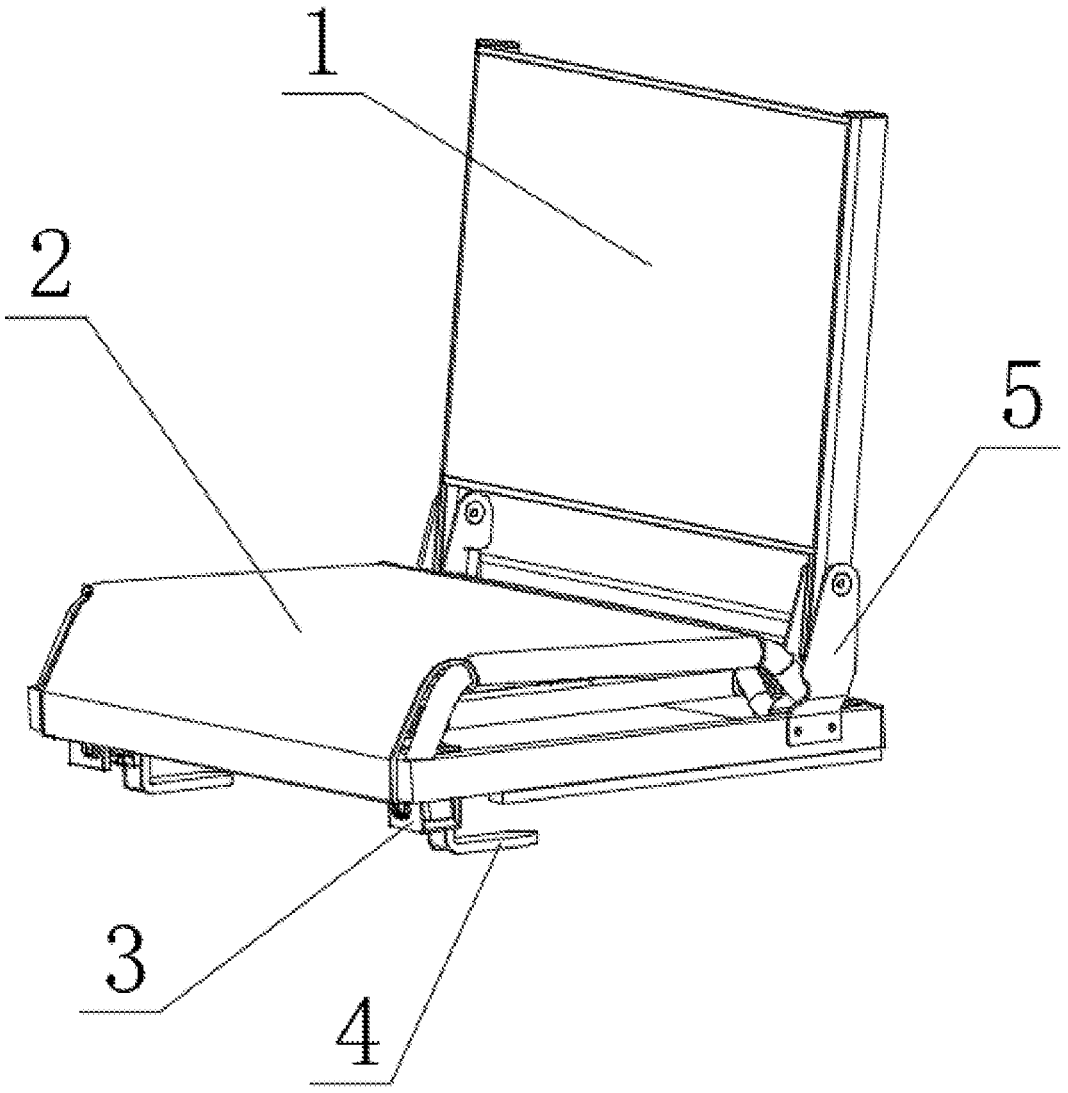
FIG. 1*a* is a working position diagram of a dual-use bleacher seat serving as a bleacher seat.

In the figures: 1, backrest; 2, cushion assembly; 3, U-shaped elastic connector; 4, L-shaped hook; 5, metal connecting piece; 6, U-shaped leg tube; 7, L-shaped elastic leg pad; 8, cushion frame; 9, seat cloth; 10, U-shaped metal sheet; 11, elastic piece with round pin; 12, oblique concave face; 13, clamping protrusion; 14, press protruding point; 15, press mark.

DETAILED DESCRIPTION OF THE INVENTION

The technical solution of the utility model is further described and explained below with reference to specific embodiments to be understood more clearly. Those skilled in the art can easily appreciate other advantages and effects of the utility model by referring to the contents in the specification.

To simplify the description and illustration, connectors, such as bolts or rivets, are not shown in the drawings of this embodiment, and the connectors are merely illustrated by bolts or rivets in the verbal description.

As shown in the figures, this embodiment discloses a dual-use bleacher seat which comprises a backrest 1, a cushion assembly 2, two L-shaped hooks 4 and two U-shaped leg tubes 6, wherein the backrest 1 is rotatably connected to the cushion assembly 2, the two L-shaped hooks 4 are rotatably connected to the left and right sides of the front end of the bottom surface of the cushion assembly 2 respectively, and the two U-shaped leg tubes 6 are rotatably connected to the left and right sides of the bottom surface of the cushion assembly 2 respectively. Wherein, the backrest 1, the L-shaped hooks 4 and the U-shaped leg tubes 6 can be folded to be stored to allow the dual-use bleacher seat to be carried conveniently and to be stored in a small space.

Specifically, the cushion assembly 2 comprises a seat cloth 9 and a rectangular cushion frame 8, wherein the left and right sides of the seat cloth 9 are fixedly mounted on the left and right sides of the cushion frame 8, and a concave cavity is formed between the lower surface of the seat cloth 9 and the cushion frame 8. When rotated to be folded on the cushion assembly 2, the U-shaped leg tubes 6 are received in the concave cavity, the L-shaped hooks 4 are rotatably connected to the bottom surface of the cushion assembly 2, and the L-shaped hooks 4 and the U-shaped leg tubes 6 are folded in a staggered manner to be received in the concave cavity.

Figure 1B:
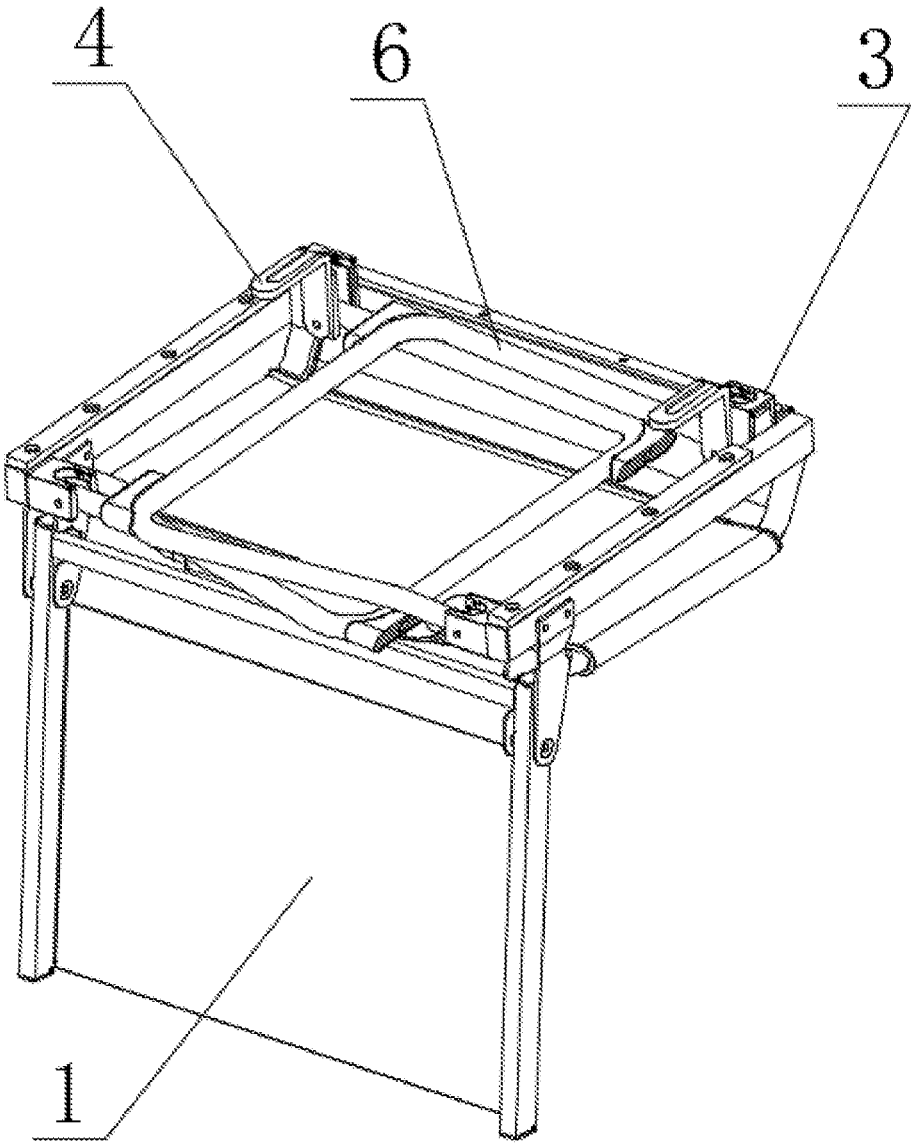
FIG. 1*b* is a turned and reversed position diagram of the dual-use bleacher seat serving as a bleacher seat.
Figure 2A:
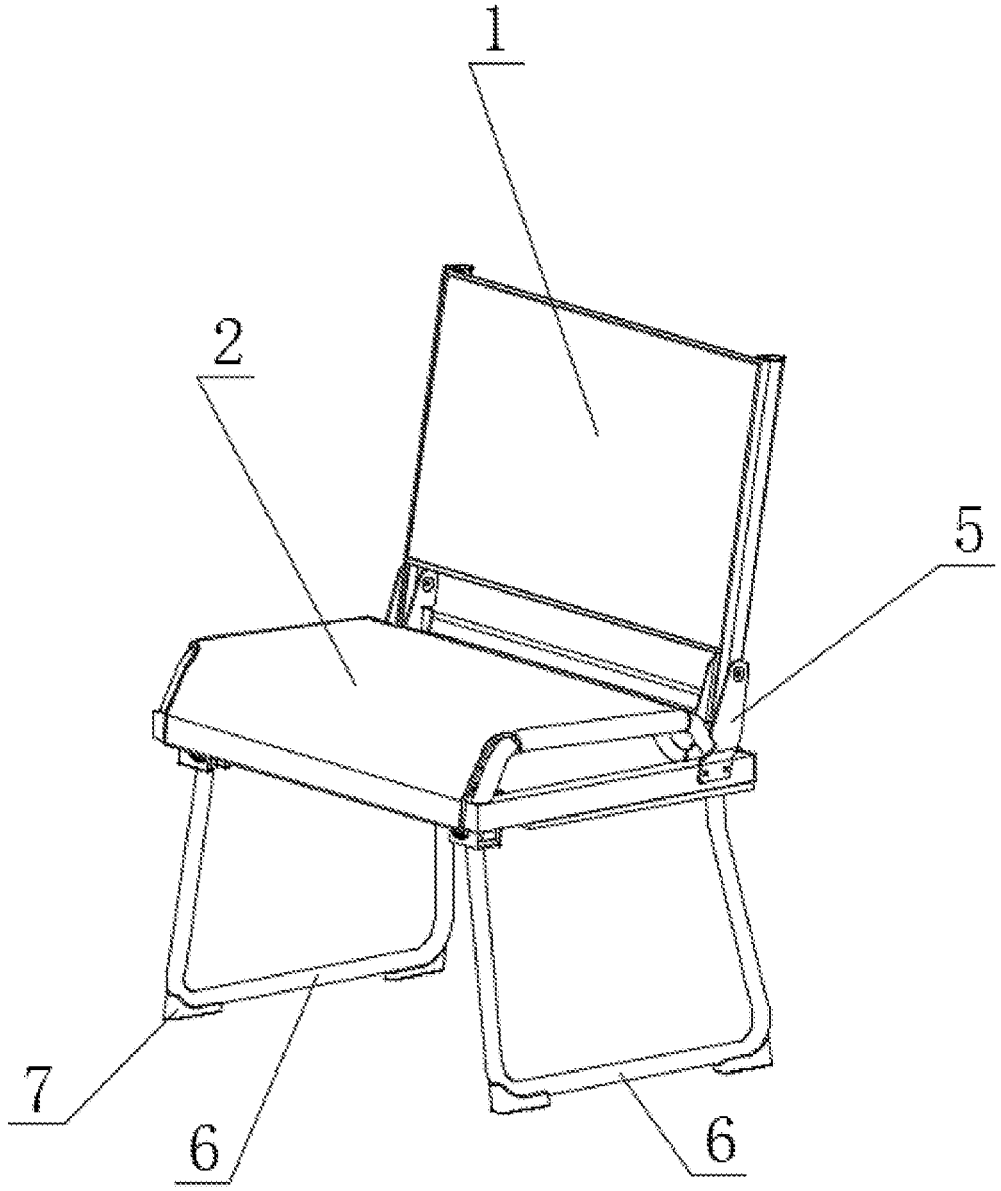
FIG. 2*a* is a working position diagram of the dual-use bleacher seat serving as a leisure chair.
Figure 2B:
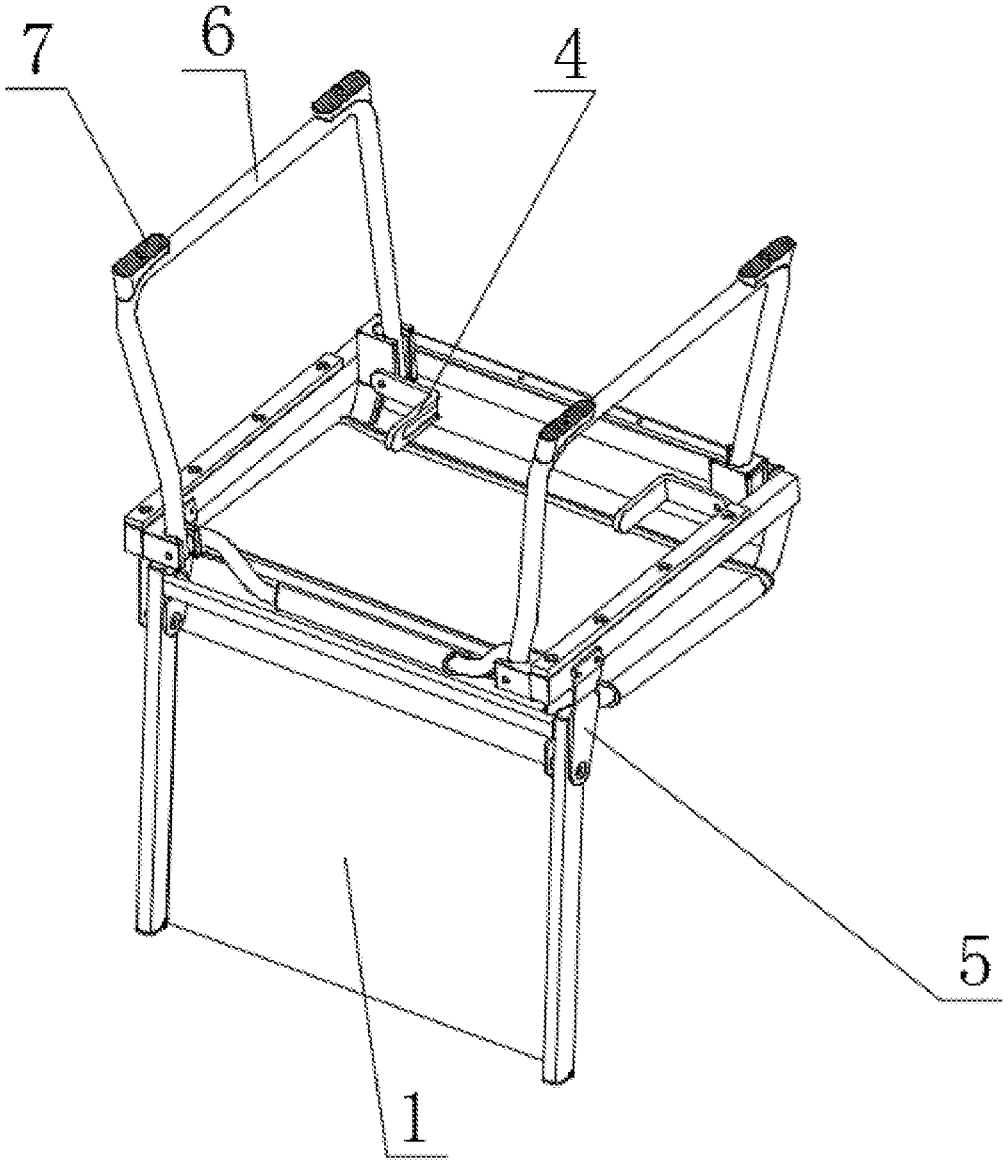
FIG. 2*b* is a turned and reversed position diagram of the dual-use bleacher seat serving as a leisure chair.
Figure 3A:
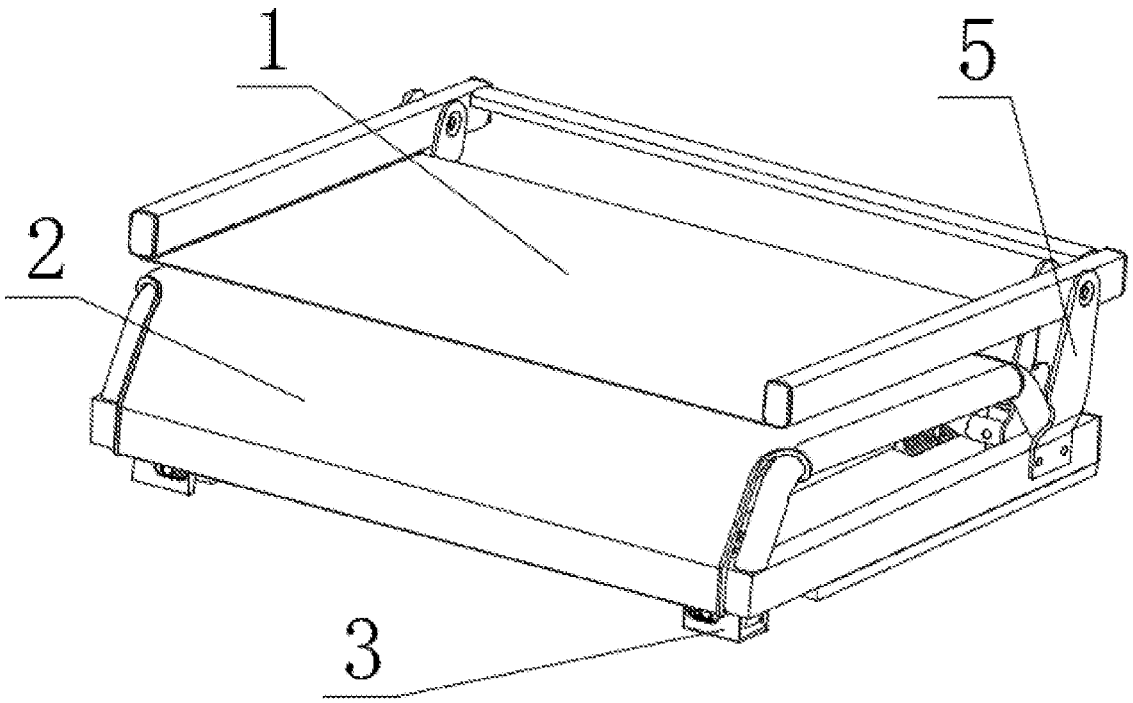
FIG. 3*a* is a front view of the dual-use bleacher seat in a folded and stored state.
Figure 3B:
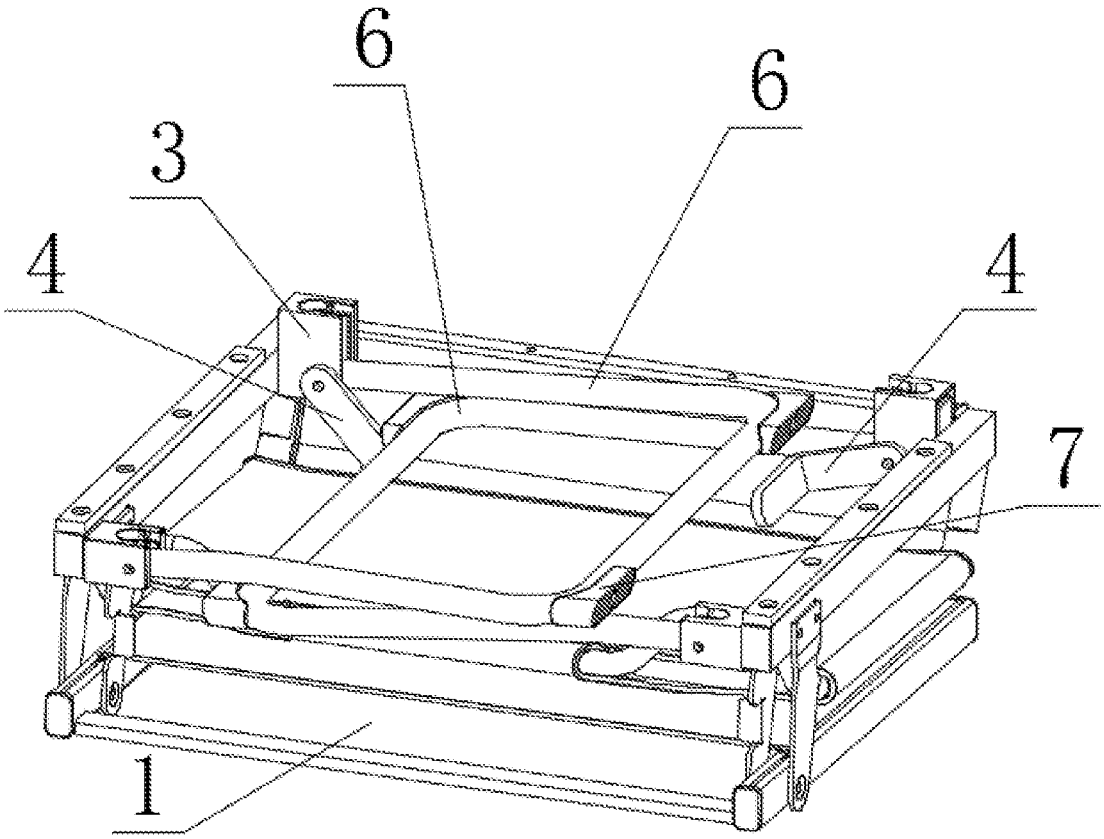
FIG. 3*b* is a diagram of the dual-use bleacher seat in the folded and stored state, with the bottom surface being turned.

When the dual-use bleacher seat is unfolded to serve as a bleacher seat (as shown in FIG. 1*a* and FIG. 1*b*), the U-shaped leg tubes 6 are folded to be hidden in the concave cavity of the cushion assembly 2, and the L-shaped hooks 4 can be hooked on a bleacher. When the dual-use bleacher seat is unfolded to serve as a leisure chair (as shown in FIG. 2*a* and FIG. 2*b*), the L-shaped hooks 4 are folded to be hidden in the concave cavity of the cushion assembly 2, and the U-shaped leg tubes 6 are unfolded to support the seat. When the dual-use bleacher seat is in a folded and stored state (as shown in FIG. 3*a* and FIG. 3*b*), the L-shaped hooks 4 and the U-shaped leg tubes 6 are folded in a staggered manner to be hidden in the concave cavity of the cushion assembly 2, and at this moment, the backrest 1 is folded towards the cushion assembly 2.

Figure 4:
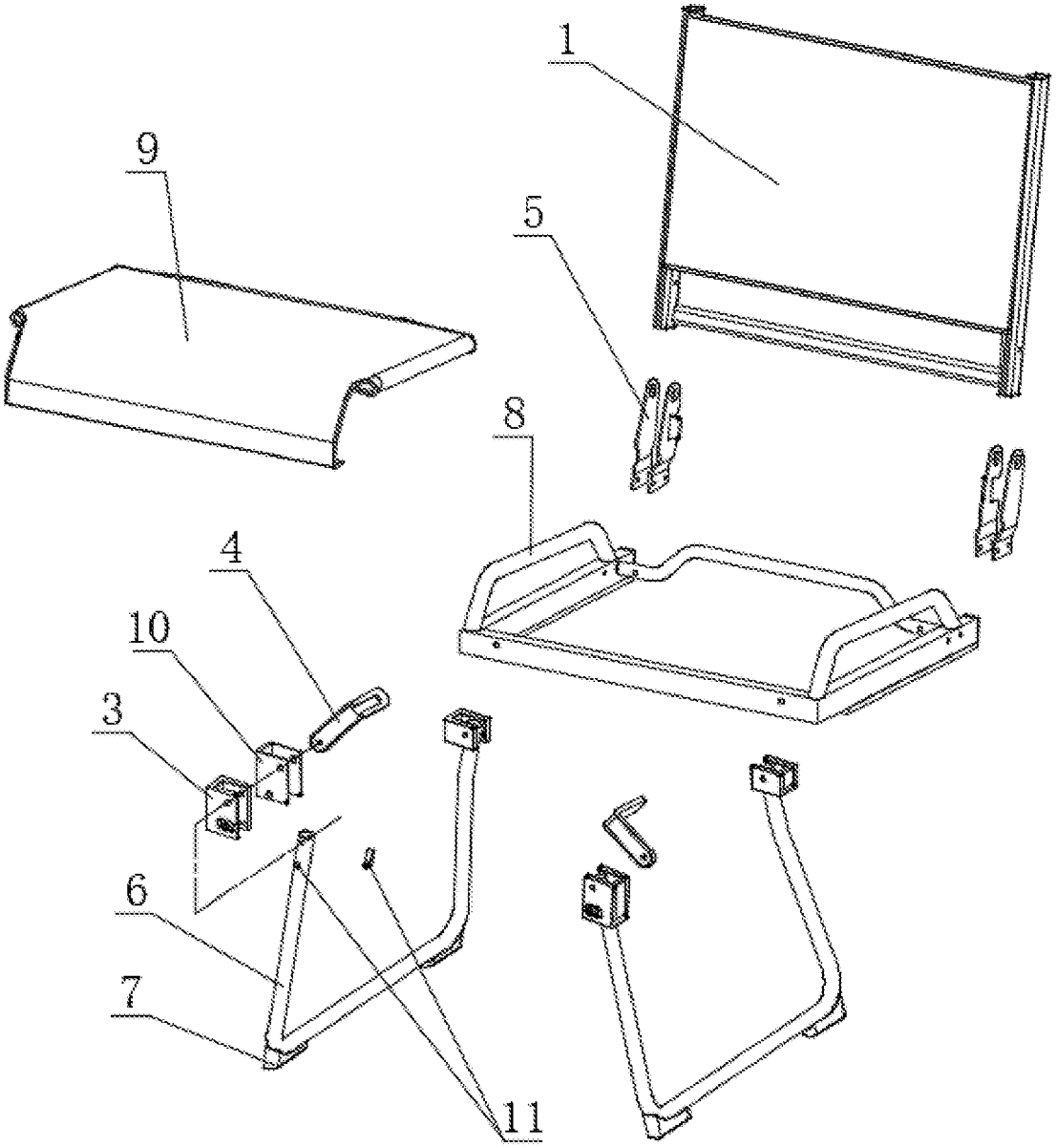
FIG. 4 is an exploded view of parts of the dual-use bleacher seat.
Figure 5A:
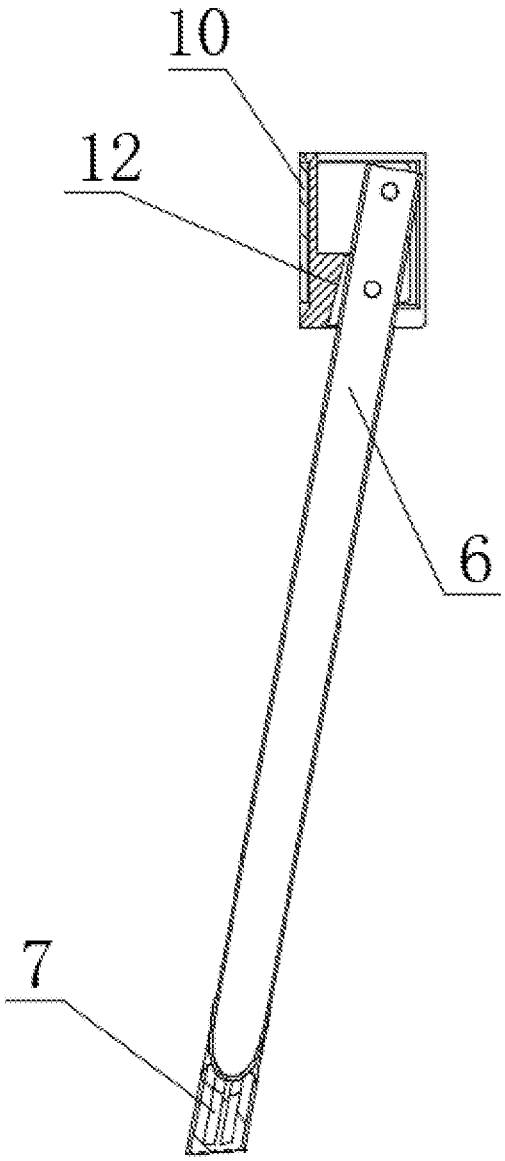
FIG. 5*a* is a schematic diagram of a leg tube in an unfolded state when the dual-use bleacher seat serves as a leisure chair.
Figure 5B:
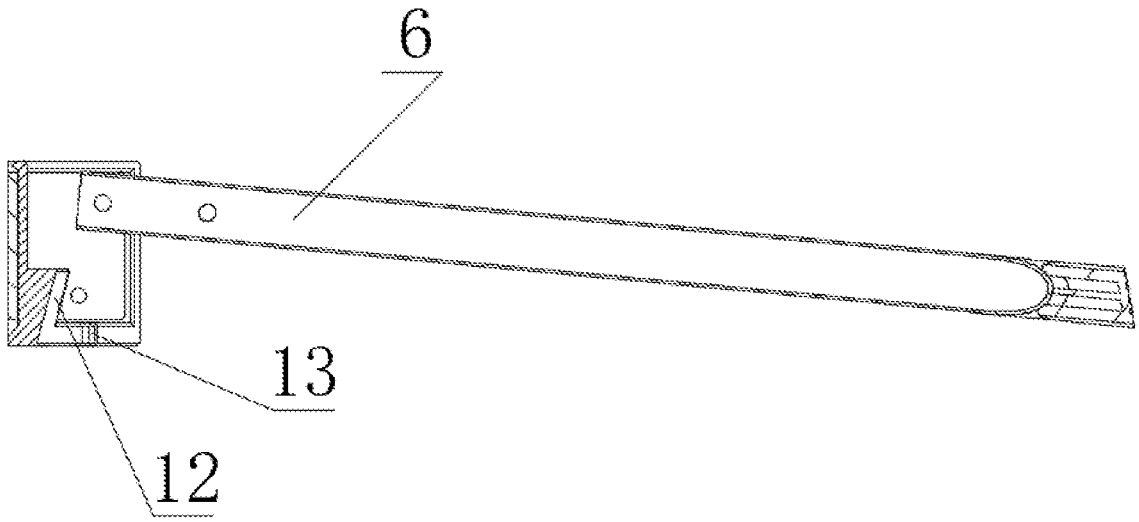
FIG. 5*b* is a schematic diagram of the leg tube in a folded state when the dual-use bleacher seat serves as a leisure chair.

Principal structural combination and assembly of the dual-use bleacher seat in this embodiment are shown in the exploded view (FIG. 4). The dual-use bleacher seat is mainly composed of a backrest 1, four metal connecting pieces 5, a cushion assembly 2, four U-shaped elastic connectors 3 (preferably made of plastic), four U-shaped metal sheets 10, two U-shaped leg tubes 6, two elastic pieces with round pins 11 (U-shaped elastic pieces are preferred, and the round pins are disposed on one side of the elastic pieces), and two L-shaped hooks 4, wherein the cushion assembly 2 is composed of a cushion frame 8 and a seat cloth 9.

The backrest 1 is rotatably connected to the metal connecting pieces 5 in a riveted manner through two vertical tubes on the left and right sides, the other end of each metal connecting piece 5 is fixedly connected to the cushion frame 8 in a riveted manner, and the seat cloth 9 is mounted and fixed on the upper side of the cushion frame 8, so that a concave cavity will be formed between the cushion assembly 2 and the ground in the working condition.

The four U-shaped elastic connectors 3 are fixedly mounted at four corners of the bottom surface of the cushion frame 8 respectively, and the four U-shaped metal sheets 10 are wrapped and mounted in inner cavities of the four U-shaped elastic connectors 3. The two L-shaped hooks 4 are mounted on the two U-shaped elastic connectors 3 at the two ends of a cross rod, on the front side of the seat, of the cushion frame 8 through bolts and nuts respectively and are located on one side of the concave cavity of the cushion assembly 2 (as shown in FIG. 1*a*, FIG. 1*b*, FIG. 2*a* and FIG. 2*b*). The left and right sides of the two U-shaped leg tubes 6 are mounted in the inner cavities of the four U-shaped elastic connectors 3 respectively, the two elastic pieces with round pins 11 are hidden and mounted in open ends of outer tubes of the U-shaped elastic connectors 3 respectively (as shown in FIG. 4), and the round pin of each elastic piece with the round pin 11 is clamped in a through hole of one U-shaped elastic connector 3 and is opposite to a press protruding point 14 on the U-shaped elastic connector 3. Four L-shaped elastic leg pads (made of plastic) are fixedly mounted on the sides, towards the ground, of U-shaped bent parts of the two U-shaped leg tubes 6 respectively.

Figure 6A:
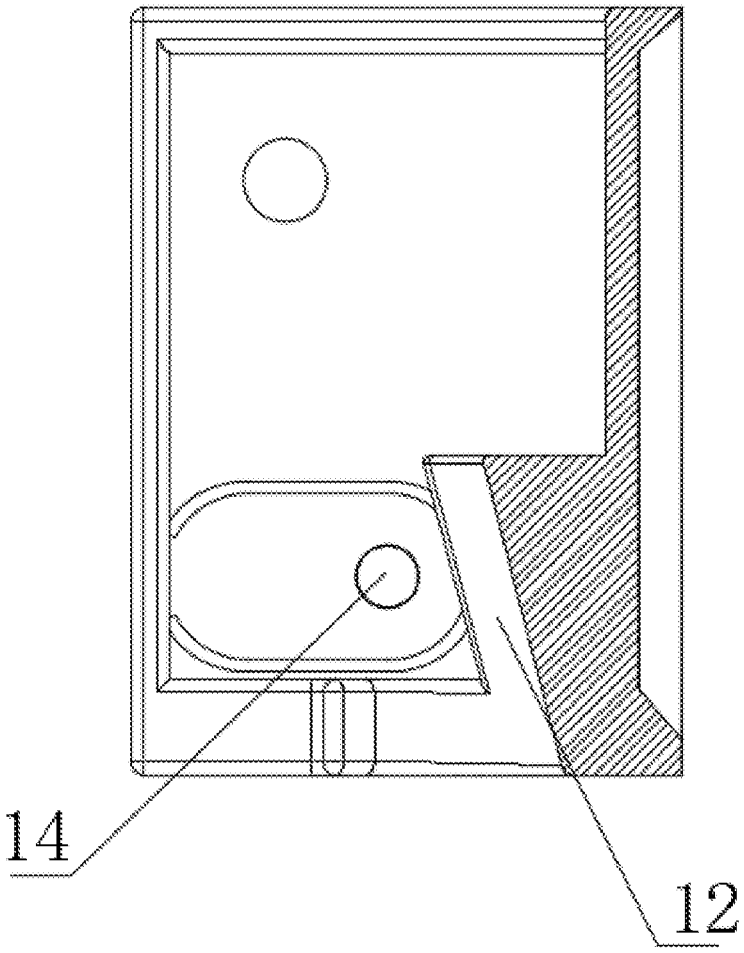
FIG. 6*a* is a semi-sectional view of a U-shaped connector.
Figure 6B:
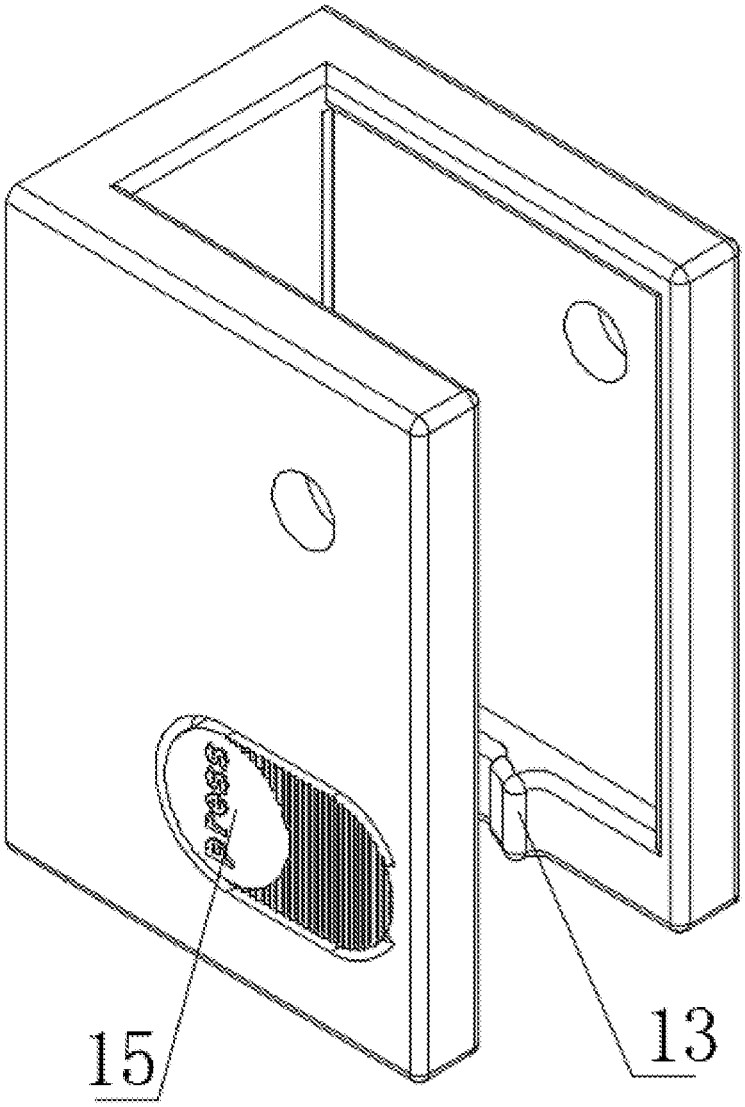
FIG. 6*b* is a perspective view of the U-shaped connector.

Referring to FIG. 6*a* and FIG. 6*b*, each U-shaped elastic connector 3 is a U-shaped plastic structural member, wherein a press mark 15 is designed on an exposed side of the U-shaped elastic connector 3, one press protruding point 14 is designed on the side, towards a U-shaped cavity, of the U-shaped elastic connector 3 and corresponds to the press mark 15, an oblique concave face 12 is designed in the U-shaped cavity of the U-shaped elastic connector 3 and is matched with one U-shaped leg tube 6 in an unfolded state, two clamping protrusions 13 which are bilaterally symmetrical to each other are designed at the positions, where the U-shaped leg tubes 6 are fixed and supported in the unfolded state, of the oblique concave face 12, and the oblique concave face 12 and the clamping protrusions 13 are used to support the U-shaped leg tube 6 in the unfolded state.

As shown in FIG. 1*a* and FIG. 1*b*, when the dual-use bleacher seat in this embodiment is unfolded to serve as a bleacher seat, the U-shaped leg tubes 6 are folded to be hidden in the concave cavity of the cushion assembly 2, at this moment, the L-shaped hooks are rotated and opened to be perpendicular to the seat cloth 9 and are then locked with nuts, and finally, the L-shaped hooks are hooked on a bleacher.

As shown in FIG. 2*a*, FIG. 2*b*, FIG. 5*a* and FIG. 5*b*, when the dual-use bleacher seat in this embodiment is unfolded to serve as a leisure chair, the U-shaped leg tubes 6 are unfolded, at this moment, the U-shaped leg tubes 6 and the elastic pieces with the round pins 11 lean against the oblique concave faces 12 of the U-shaped elastic connectors 3, and the round pins of the elastic pieces 11 stretch out of the outer ends of the U-shaped leg tubes 6 to be clamped in the through holes of the U-shaped metal sheets 10 and are exactly aligned to the press protruding points 13 on the U-shaped elastic connectors 3 in position; in this state, the round pins of the elastic pieces 11 are clamped in the through holes of the U-shaped metal sheets 10 to fulfill fixation, and the outer round tube walls of the U-shaped leg tubes 6 are supported and fixed by the clamping protrusions 13 on the U-shaped elastic connectors 3 at this moment. When the U-shaped leg tubes 6 need to be folded to be stored, a user can press the press marks 15 on the U-shaped elastic connectors 3 by hand to push the elastic press protruding points 14 towards the round pins of the elastic pieces 11 to enable the round pins of the elastic pieces to disengage from the through holes of the U-shaped metal sheets 10, and then, the U-shaped leg tubes are rotated by a certain angle to be finally received in the concave cavity of the cushion assembly 2.

As shown in FIG. 3*a* and FIG. 3*b*, when the dual-use bleacher seat in this embodiment is folded to be stored state, the L-shaped hooks 4 and the U-shaped leg tubes are mechanically rotated and pressed with reference to the above-mentioned unfolding steps so as to be completely hidden in the concave cavity of the cushion assembly 2, and at this moment, the backrest assembly 1 of the seat is rotated and folded towards the cushion assembly 2, so that the dual-use bleacher seat is folded and stored.

The aforementioned embodiments are merely preferred ones of the utility model, and are not intended to limit the protection scope of the utility mode, and all transformations and improvements made by those skilled in the art according to the design concept of the utility model should fall within the protection scope of the utility model.

More particularly, various transformations and improvements can be made to the constituent parts and/or the layout of the subject matter within the scope of the drawings and claims of this application. In addition to these transformations and improvements to the constituent parts and/or the layout, other applications will also be obvious to those skilled in the art.

What is claimed is:

1. A dual-use bleacher seat, comprising a backrest, a cushion assembly and two L-shaped hooks, wherein the backrest is connected to the cushion assembly, and the two L-shaped hooks are arranged on left and right sides of a front end of a bottom surface of the cushion assembly respectively; and the dual-use bleacher seat further comprises two U-shaped leg tubes which are rotatably connected to left and right sides of the bottom surface of the cushion assembly respectively; and further comprising four U-shaped elastic connectors, wherein a U-shaped metal sheet is wrapped and mounted in an inner cavity of each of said U-shaped elastic connectors, the four U-shaped elastic connectors are symmetrically mounted at four corners of the bottom surface of the cushion assembly, wherein an upper end of each of said two L-shaped hooks is rotatably connected to an outer wall of each of two of said four U-shaped elastic connectors on a front side of the cushion assembly, and two ends of each said U-shaped leg tube are arranged in the inner cavities of two of said four U-shaped elastic connectors on a left or right side of the cushion assembly respectively and are rotatably connected to the U-shaped elastic connectors.

2. The dual-use bleacher seat according to claim 1, wherein a concave cavity is formed in the bottom surface of the cushion assembly, and when rotated to be folded on the cushion assembly, the U-shaped leg tubes are received in the concave cavity.

3. The dual-use bleacher seat according to claim 2, wherein the L-shaped hooks are rotatably connected to the bottom surface of the cushion assembly, and the L-shaped hooks and the U-shaped leg tubes are folded in a staggered manner to be received in the concave cavity.

4. The dual-use bleacher seat according to claim 3, wherein the backrest is rotatably connected to the cushion assembly.

5. The dual-use bleacher seat according to claim 4, further comprising a metal connecting piece, wherein an upper end of the metal connecting piece is riveted to a lower left end or a lower right end of the backrest, and a lower end of the metal connecting piece is riveted to a left rear end or a right rear end of the cushion assembly.

6. The dual-use bleacher seat according to claim 2, wherein the cushion assembly comprises a seat cloth and a rectangular cushion frame, left and right sides of the seat cloth are fixedly mounted on left and right sides of the cushion frame, and the concave cavity is formed between a lower surface of the seat cloth and the cushion frame.

7. The dual-use bleacher seat according to claim 6, wherein the backrest is rotatably connected to the cushion assembly.

8. The dual-use bleacher seat according to claim 7, further comprising a metal connecting piece, wherein an upper end of the metal connecting piece is riveted to a lower left end or a lower right end of the backrest, and a lower end of the metal connecting piece is riveted to a left rear end or a right rear end of the cushion assembly.

9. The dual-use bleacher seat according to claim 6, further comprising L-shaped elastic leg pads which are mounted on sides, towards a ground, of two bent parts of a cross tube of each said U-shaped leg tube.

10. The dual-use bleacher seat according to claim 2, wherein the backrest is rotatably connected to the cushion assembly.

11. The dual-use bleacher seat according to claim 10, further comprising a metal connecting piece, wherein an upper end of the metal connecting piece is riveted to a lower left end or a lower right end of the backrest, and a lower end of the metal connecting piece is riveted to a left rear end or a right rear end of the cushion assembly.

12. The dual-use bleacher seat according to claim 1, further comprising elastic pieces with round pins, wherein the elastic pieces with the round pins are mounted in open ends of outer tubes of the U-shaped leg tubes, and the round pin of each said elastic piece is clamped in a through hole in one side of the corresponding U-shaped elastic connector and is opposite to a press protruding point in the inner cavity of the U-shaped elastic connector; and press marks are arranged on outer walls, corresponding to the press protruding points, of the U-shaped elastic connectors.

13. The dual-use bleacher seat according to claim 12, wherein oblique concave faces and clamping protrusions are further arranged in the inner cavities of the U-shaped elastic connectors; and when the U-shaped leg tubes are in an unfolded state, outer walls of tube ends of the U-shaped leg tubes abut against the oblique concave faces and the clamping protrusions.

14. The dual-use bleacher seat according to claim 12, further comprising L-shaped elastic leg pads which are mounted on sides, towards a ground, of two bent parts of a cross tube of each said U-shaped leg tube.

15. The dual-use bleacher seat according to claim 1, wherein oblique concave faces and clamping protrusions are further arranged in the inner cavities of the U-shaped elastic connectors; and when the U-shaped leg tubes are in an unfolded state, outer walls of tube ends of the U-shaped leg tubes abut against the oblique concave faces and the clamping protrusions.

16. The dual-use bleacher seat according to claim 1, further comprising L-shaped elastic leg pads which are mounted on sides, towards a ground, of two bent parts of a cross tube of each said U-shaped leg tube.

17. The dual-use bleacher seat according to claim 1, wherein the backrest is rotatably connected to the cushion assembly.

18. The dual-use bleacher seat according to claim 17, further comprising a metal connecting piece, wherein an upper end of the metal connecting piece is riveted to a lower left end or a lower right end of the backrest, and a lower end of the metal connecting piece is riveted to a left rear end or a right rear end of the cushion assembly.

19. The dual-use bleacher seat according to claim 1, further comprising L-shaped elastic leg pads which are mounted on sides, towards a ground, of two bent parts of a cross tube of each said U-shaped leg tube.

* * * * *